United States Patent [19]

Nederveld

[11] Patent Number: 4,645,122

[45] Date of Patent: Feb. 24, 1987

[54] CONTAINER FOR PRODUCE AND THE LIKE

[75] Inventor: Terrill L. Nederveld, Ada, Mich.

[73] Assignee: Packaging Corporation of America, Evanston, Ill.

[21] Appl. No.: 823,679

[22] Filed: Jan. 29, 1986

[51] Int. Cl.[4] ..... B65D 5/32

[52] U.S. Cl. ..... 229/45 R; 206/509; 229/23 R; 229/109; 229/120; 229/916

[58] Field of Search ..... 229/23 R, 23 C, 44 R, 229/45 R, DIG. 11, DIG. 4, 109, 120, 126, 915, 916, 919, DIG. 14; 206/509

[56] References Cited

U.S. PATENT DOCUMENTS

| | | | |
|---|---|---|---|
| 2,013,712 | 9/1935 | Evans | 229/DIG. 11 |
| 3,373,921 | 11/1966 | Crane | 229/23 |
| 3,623,650 | 11/1971 | Watts | 229/DIG. 11 |
| 3,713,579 | 1/1973 | Chaffers | 229/44 R |
| 3,937,390 | 2/1976 | Winkler | 229/23 R |
| 4,211,358 | 7/1980 | Crane | 229/23 |
| 4,277,015 | 7/1981 | Crane | 229/23 |
| 4,291,830 | 9/1981 | Sorensen | 229/45 R |
| 4,389,013 | 6/1983 | Hall et al. | 229/45 R |
| 4,497,408 | 2/1985 | Jes | 229/23 R |

*Primary Examiner*—William Price
*Assistant Examiner*—Gary E. Elkins
*Attorney, Agent, or Firm*—Neuman, Williams, Anderson & Olson

[57] ABSTRACT

A container for produce and the like is provided which includes a central section and a pair of end sections affixed thereto. The central section includes a bottom panel, upright side panels arranged in opposed spaced relation, and top closure panels. The bottom and side panels are interconnected by a pair of first joiner panels. The side and top closure panels are interconnected by a pair of second joiner panels. The upper edge portion of each end section is provided with at least one upwardly protruding member. The protruding member and the adjacent edge portion of a corresponding top closure panel are provided with complementary locking elements, the latter coacting to effect locking of the top closure panel in a predetermined folded position. The second joiner panels are disposed in abutting engagement with adjacent edge portions of the end sections, thereby restraining lateral relative movement of the top closure panels when the latter are in said predetermined folded position.

7 Claims, 10 Drawing Figures

FIG. 5
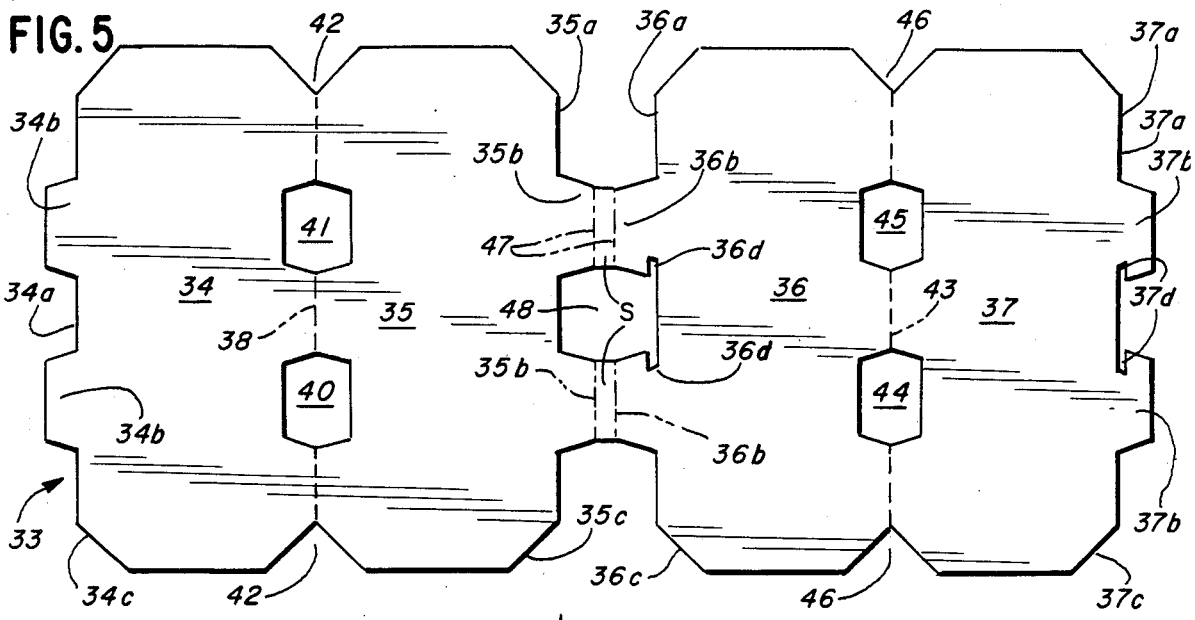
FIG. 6
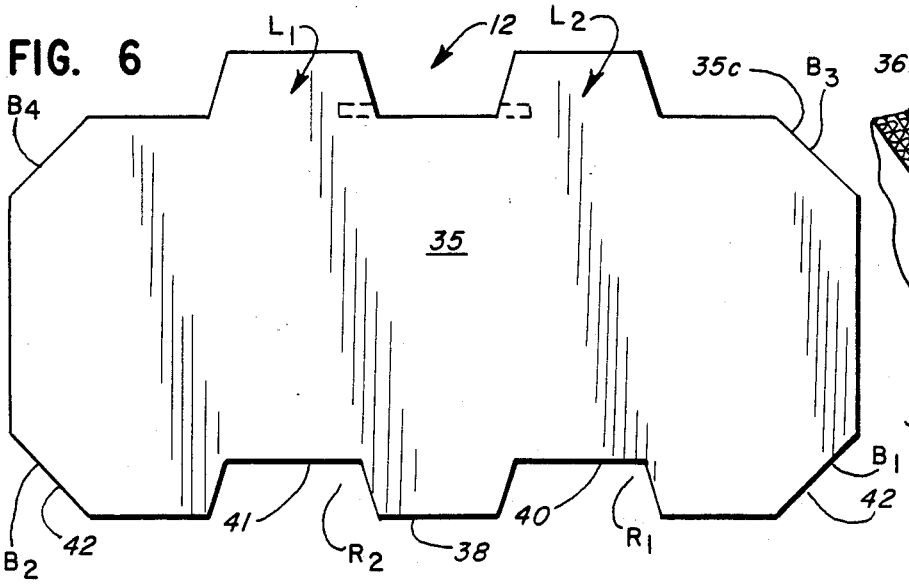
FIG. 7
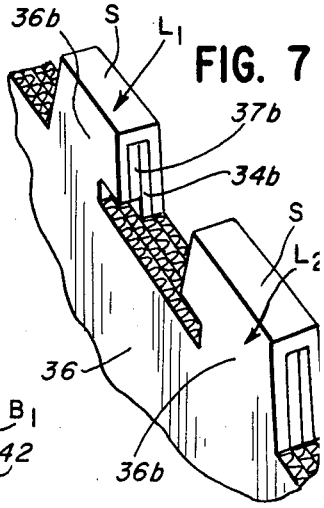
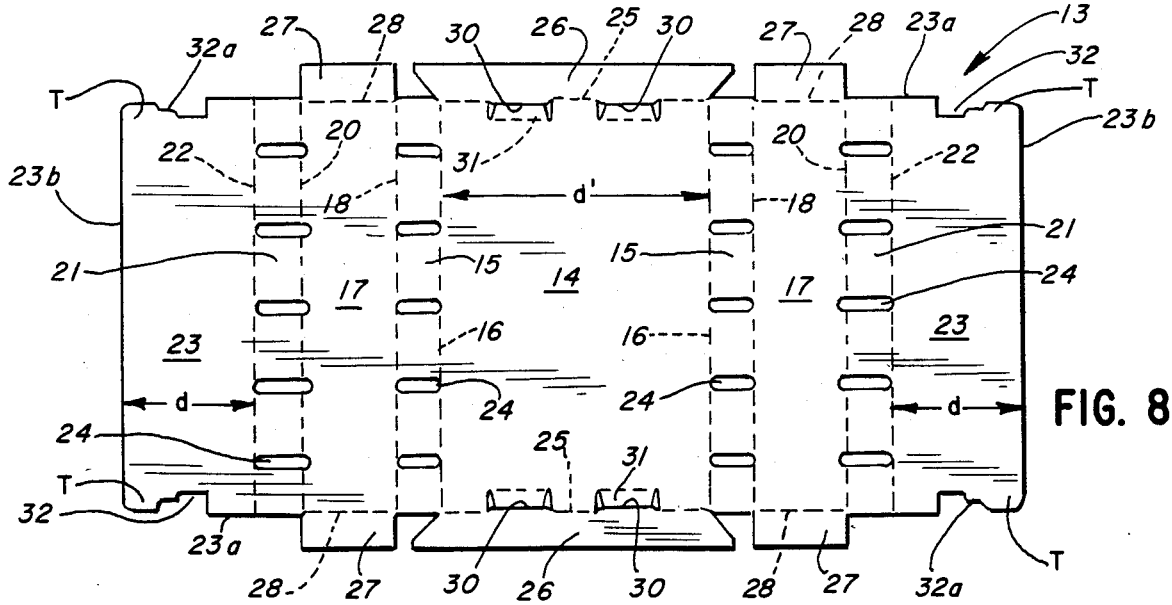
FIG. 8

FIG. 5A
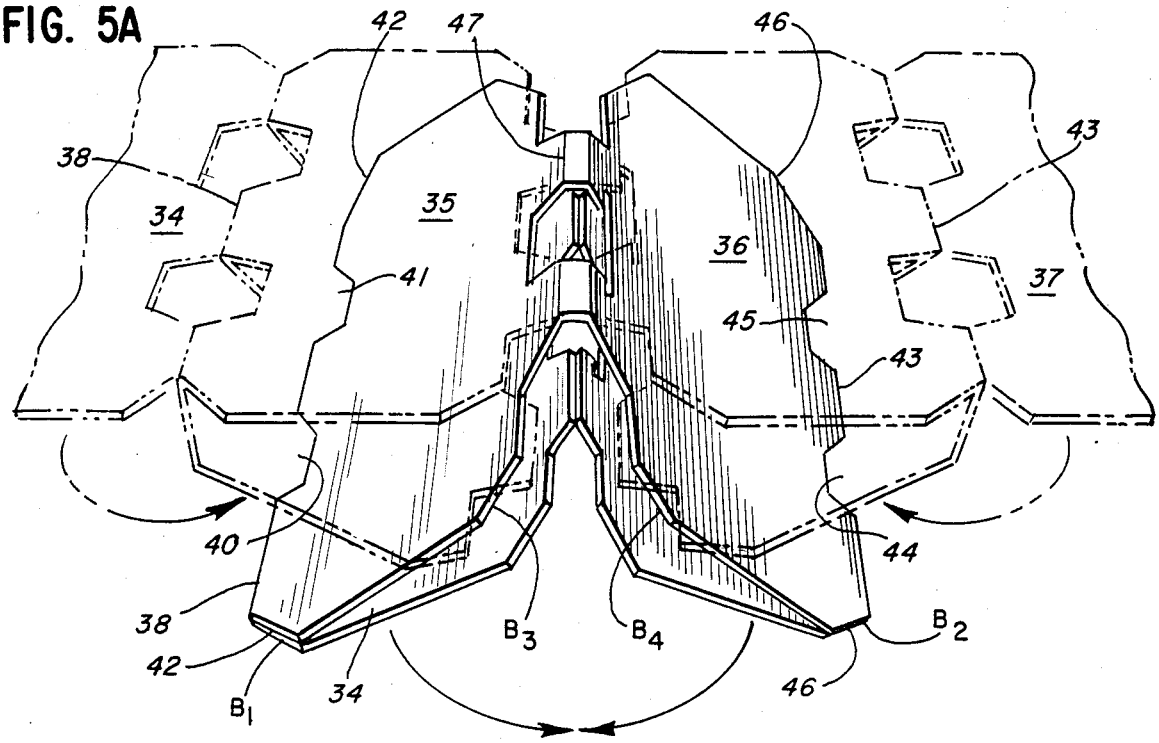
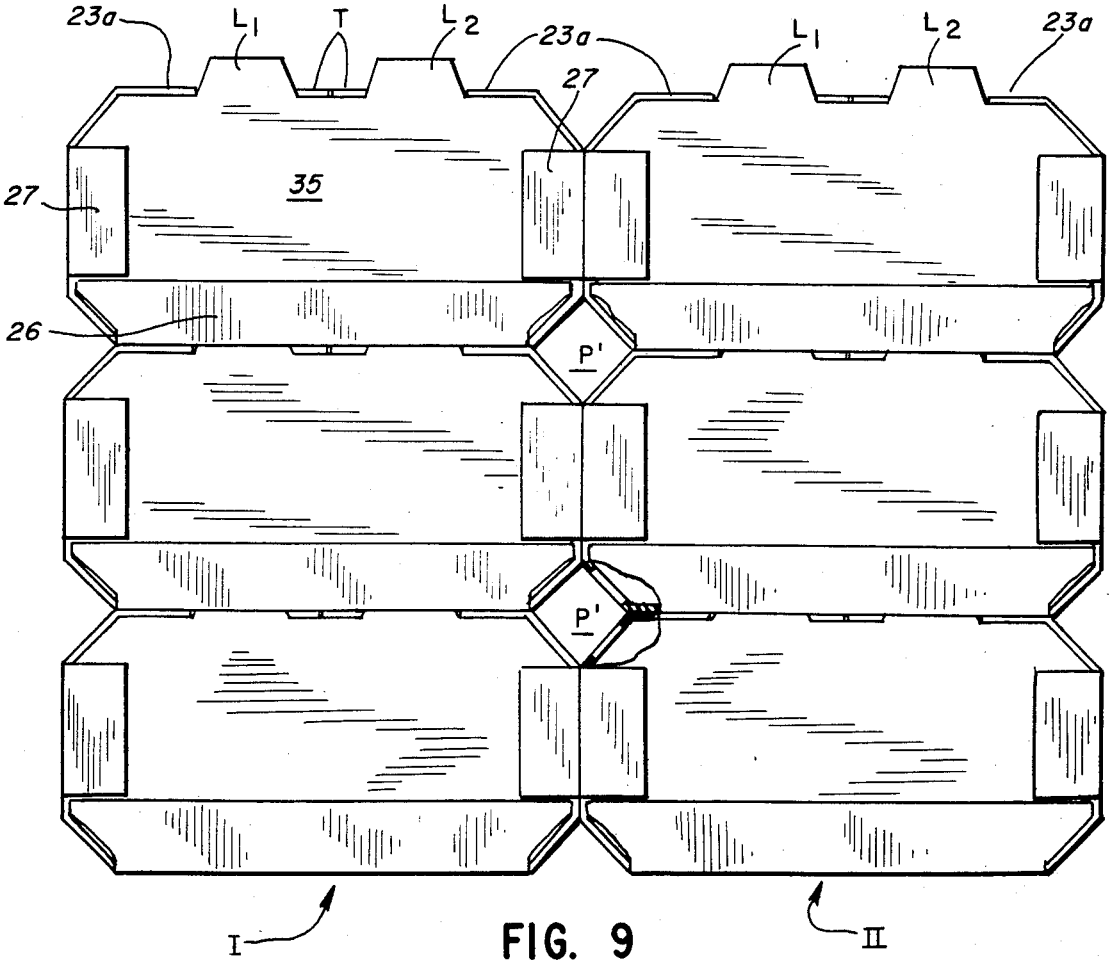
FIG. 9

CONTAINER FOR PRODUCE AND THE LIKE

BACKGROUND OF THE INVENTION

In the bulk packaging of fresh produce (e.g., grapes) it is important that the container therefor provides adequate protection for the produce; provides ventilation for the accommodated produce; the container has adequate stacking strength even when the stacked containers are subjected to extreme climatic conditions; the container has a positive locking system wherein the loaded container remains closed even when subjected to abusive handling; the container is of simple, inexpensive construction and capable of being readily manipulated manually into a closed condition; and is attractive in appearance enabling the accommodated produce to remain within the container when being displayed for retail sale to a customer. Prior containers of this general type fail to embody and possess all of the aforenoted virtuous characteristics.

SUMMARY OF THE INVENTION

Thus, it is an object of the invention to provide an improved container of the type described which is possessed of all of the aforenoted advantages.

It is a further object to provide an improved container which is capable of being readily interlocked in a stable stacked relation with containers of like construction.

Further and additional objects will appear from the description, accompanying drawings, and appended claims.

In accordance with one embodiment of the invention, a container for the bulk handling of produce is provided. The container is formed of a central section and a pair of end sections affixed to opposite peripheral portions of the central section. Preferably the central and end sections are formed of plies of double faced corrugated fibreboard. The end sections are of multiply thickness and the central section is of a single ply thickness.

The central section includes a bottom panel, upright side panels, top closure flaps, first joiner panels foldably interconnecting the bottom panel and the upright side panels, and second joiner panels interconnecting the side panels and the top closure panels. The upper edge portion of each end section is provided with at least one upwardly protruding means. The protruding means and the adjacent side edges of the top closure panels are provided with complemental locking means for retaining the top closure panels in a predetermined folded relation. When the top closure panels are disposed in the predetermined folded relation, the second joiner panels are in abutting relation with adjacent peripheral edge portions of the end sections and thus prevent lateral relative movement of the top closure flaps.

DESCRIPTION

For a more complete understanding of the invention reference should be made to the drawings wherein:

FIG. 5 is a top plan view of a blank from which each end section of the container of FIG. 1 is formed.

FIG. 5*a* is a perspective end view of one end section in a partially set up condition; the blank in an unfolded and initial folded condition are shown in phantom lines.

FIG. 6 is an enlarged side elevational view of the end section per se.

FIG. 7 is a fragmentary perspective view of the top edge portion of the end section of FIG. 6.

Figure 1:
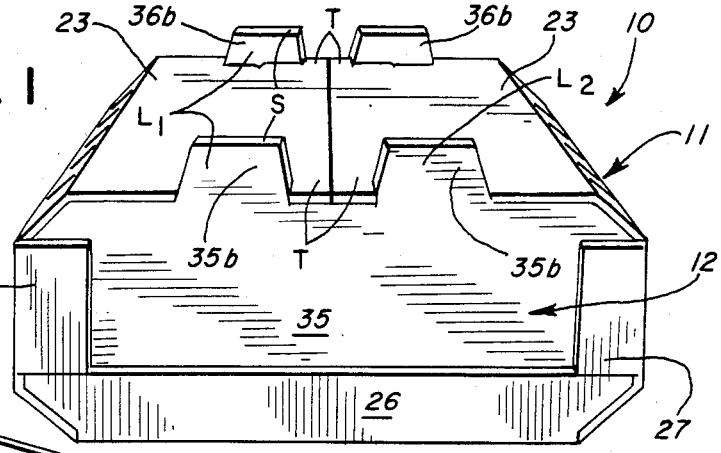
FIG. 1 is a perspective end view of one embodiment of the improved container with the top closure panels locked in a closed position.

FIG. 8 is a top plan view of a blank from which the central section of the container of FIG. 1 is formed.

FIG. 9 is an end view of a plurality of containers arranged in two stacks, said stacks being disposed in side by side relation.

Figure 2:
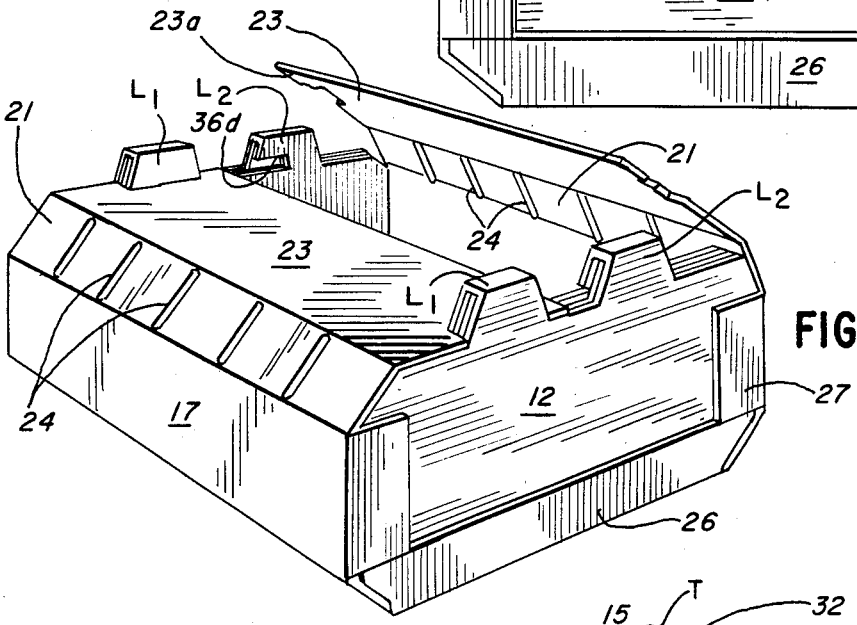
FIG. 2 is a perspective view of the container of FIG. 1 and showing one top closure flap in a partially open position.
Figure 3:
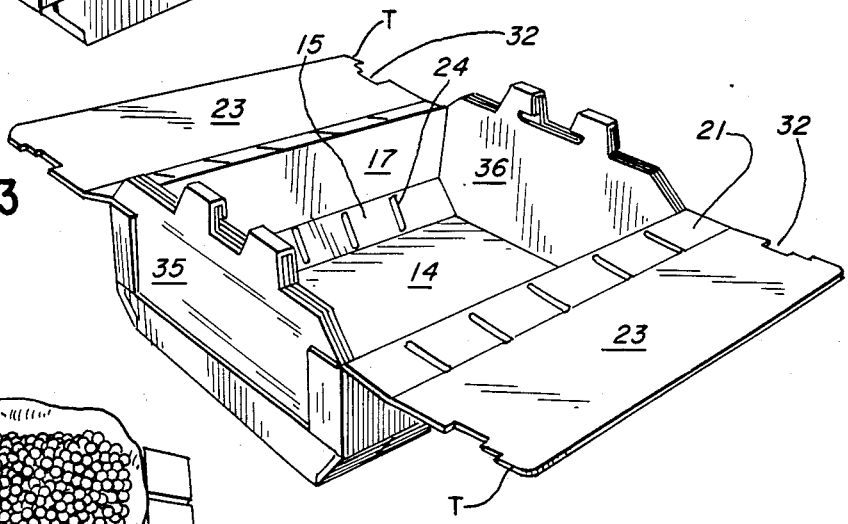
FIG. 3 is a perspective top view of the container of FIG. 1 and showing the top closure panels in a fully open position and the container ready for loading.
Figure 4:
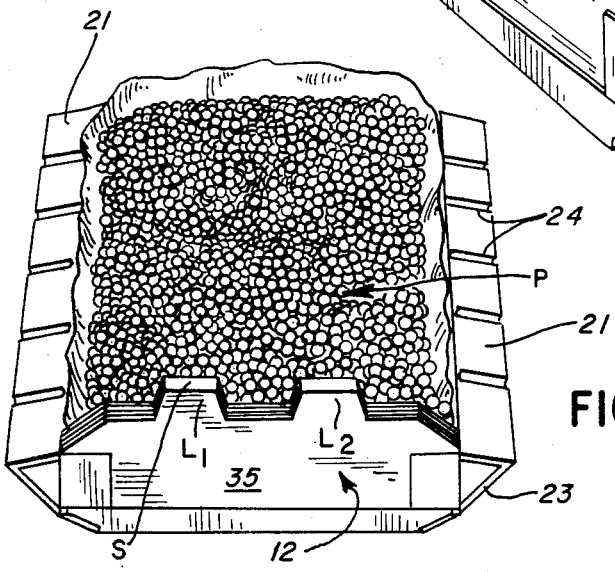
FIG. 4 is a perspective top view of a fully loaded container with the top closure panels thereof fully open and exposing the accommodated produce.

Referring now to the drawings and more particularly to FIGS. 1–3, one embodiment of an improved container 10 is shown which is suitable for accommodating in bulk form fresh produce P such as table grapes and the like, see FIG. 4. Basically, container 10 is formed of a central section 11 and a pair of upright end sections 12 which are affixed by adhesive, staples or the like to opposite peripheral portions of the central section. Both the central and end sections are preferably formed of plies of double faced corrugated fibreboard material.

The central section 11 is formed from a blank 13, see FIG. 8, of single ply double faced, corrugated, fibreboard material which has been pre-treated so as to be moisture resistant. Blank 13 includes a bottom panel 14, preferably of rectangular configuration; a pair of relatively narrow first joiner panels 15 connected by foldlines 16 to the elongated opposed side edges of the bottom panel; and a pair of upright side panels 17 connected by foldlines 18 to the joiner panels. Foldlines 16 and 18 are disposed in spaced parallel relation. Connected by foldlines 20 to peripheral portions of the side panels 17 opposite foldlines 18 are a pair of relatively narrow second joiner panels 21. Disposed outwardly from the second joiner panels 21 and connected thereto by foldlines 22 are top closure panels 23. As will be noted in FIG. 8, each of the joiner panels 15 and 21 is provided with a plurality of openings 24 for ventilation. Connected by foldlines 25 to the opposite shorter peripheral portions of bottom panel 14 are a pair of glue flaps 26. In a similar manner, a pair of glue flaps 27 are connected by foldlines 28 to the shorter peripheral portions of side panels 17. As seen in FIG. 8, each foldline 25 is interrupted by a pair of relatively spaced openings 30. Each opening 30 has a yieldable tab 31 extending therein from a perimetric portion of the opening disposed inwardly from the adjacent glue flap 26. The function of the openings 30 and tabs 31 will be described more fully hereinafter.

Each narrow end edge 23*a* of each top closure panel is provided with a notch 32 spaced a predetermined distance inwardly from the outer edge 23*b* of the top closure panel 23 so as to form a tongue T. The side of each notch 32 adjacent the tongue is provided with a step 32*a*. The notches and tongues form a locking component and will be described more fully hereinafter. The dimension d of each closure panel 23, as shown in FIG. 8, is approximately one-half the dimension d' of the bottom panel 14 so that, when the closure panels 23 are in the closed position, as shown in FIG. 1, the edges 23*b* of the panels 23 will be in close proximity to one another and thus, substantially conceal the produce P within the container.

Each end section 12 is preferably of like configuration and is formed from a blank 33 of single ply double faced corrugated fibreboard material which has been pre-treated so as to be moisture resistant. Blank 33, as seen in FIG. 5, includes four panels 34, 35, 36 and 37 which are arranged in side by side relation. Panels 34,35 are connected by foldline 38 which is interrupted by a pair of openings 40 and 41 of like configuration. Approximately one-half of each opening 40,41 extends into panel 34 and approximately the remaining one-half extends into panel 35. The ends of foldline 38 terminate in V-shaped notches 42.

The outer edge 34*a*,37*a* of the panels 34,37 are provided with spaced lugs or protuberances 34*b*,37*b*, see FIG. 5.

Panels 36,37 are connected by foldline 43 which is interrupted by openings 44,45 in the same manner as foldline 38 is interrupted by openings 40,41. The ends of foldline 43 terminate in V-shaped notches 46. Panels 34,37 are of like configuration and similarly panels 35,36 are of like configuration.

The edges 35*a*,36*a* of panels 35,36 respectively, which are opposite foldlines 38,43, are provided with laterally extending protuberances 35*b*,36*b*. The protuberances are interconnected by a double foldline 47. Foldline 47 is interrupted by a large opening 48 which has approximately one-half thereof extending towards panel 35 and approximately the other one-half extending towards panel 36. Thus, by reason of the opening 48, each protuberance 35*b*,36*b* is formed into a pair of laterally spaced lugs $L_1$ and $L_2$ see FIG. 1. Corresponding lugs are separated from one another by a narrow strip S which is formed between the foldlines comprising the double foldline 47. The narrowness of each strip S approximates the thickness of two plies of the double faced corrugated fibreboard material of which blank 33 is formed. The reason for this narrowness of dimension is apparent from FIG. 7 wherein corresponding peripheral lugs 34*b*,37*b* of panels 34,37 are disposed in face to face relation between corresponding lugs $L_1$ or $L_2$ of protuberances 35*b*,36*b* when blank 33 is set up to form an end section 12. In the setup end section, each narrow strip S overlies the upper edges of lugs 34*b*,37*b* as seen in FIG. 7.

When blank 33 is set up to form an end section 12, the outermost panels 34,37 of the blank are initially folded about their respective foldline 38,43 so as to underlie, respectively, panels 35,36, see FIG. 5*a*. Subsequently, the blank 33 after the aforesaid initial folding, is folded about double foldline 47 whereupon the protuberances 34*b*,37*b* are sandwiched between corresponding protuberances 35*b*,36*b*. When the end section 12 is fully set up from blank 33, the halves of openings 40, 44 and 41, 45 coact to form a pair of recesses or pockets $R_1$ and $R_2$ along the lower edge of each end section as seen more clearly in FIG. 6. Corners 34*c*, 35*c*, 36*c* and 37*c* of panels 34, 35, 36, and 37, respectively, are diagonally cut in a like manner as seen in FIG. 5 so that when the blank 33 is fully set up, the aforesaid corners coact to form bevel corner edges $B_3$ and $B_4$ along the upper edge of each end section, see FIG. 6.

It will be noted in FIG. 5, that opposing sides of lugs 37*b* are provided with short slots 37*d* which are laterally aligned with one another. In a like manner, lugs 36*b* are provided with short slots 36*d*. Corresponding slots 37*d* and 36*d* coact with one another when the blank 33 is fully set up, to form a locking component at each end of the container, which is adapted to cooperate with the corresponding locking component previously described as including notch 32 and tongue T formed in the narrow edge of each closure panel 23. Preferably, the panels 34,37 are adhesively secured together when blank 33 is set up to form an end section 12.

Once the end sections 12 have been fully set up as aforedescribed, each end section is positioned so that the lower edge thereof will rest upon the interior or concealed surface of the bottom panel adjacent foldline 25. When positioning the end section on the bottom panel of blank 13, the recesses $R_1$,$R_2$ should be in vertical alignment with openings 30 which interrupt foldline 25. Once each end section is in place relative to the bottom panel 14, glue flaps 26 are folded upwardly about foldlines 25 and adhesively secured to the exterior or exposed surface of the corresponding end section. Subsequent to the flaps 26 being adhesively affixed to the end section exterior surfaces, the first joiner panel 15 and corresponding side panel 17 are folded upwardly as a unit about foldline 16. Because of the bevelled corners $B_1$ and $B_2$ of the end section, the first joiner panels 15 will abut the bevelled corners and be restrained thereby while the side panel 17 moves to its fully upright position. When the side panel 17 is in its fully upright position it will abut the side edge portion of the end section. The glue flaps 27 extending laterally from the side panel are folded and adhesively secured to the exterior surface of the adjacent end section. Once the bottom panel and side panels have been secured to the end sections 12, the second joiner panels 21 and the top closure panels 23 are folded outwardly as seen in FIG. 3 whereby the container 10 is ready for loading. Subsequent to the container being loaded with produce P, the second joiner panels 21 and the corresponding closure panels 23 are folded as units about foldlines 20 until the joiner panels 21 abut the bevelled corners $B_3$,$B_4$ of the end sections 12. Once the joiner panels 21 are in abutting relation with the corners of the end sections, the closure panels 23 can be folded towards one another about foldlines 22 until they assume a predetermined or closed position, see FIG. 2. Because of sizing of the closure panels 23 relative to the lugs $L_1$,$L_2$, the closure panels will frictionally engage the corresponding lugs as the closure panels are manually pushed downwardly between the lugs until the step 32*a*, formed in the notch 32 in each end edge 23*a* of the closure panel 23, is aligned with the slot 36*d*,37*d* formed in the adjacent end section. Once the steps are aligned with the slots, the steps will automatically snap into interlocking relation with the end sections whereby the tongues T formed in the edges of the closure panels will be disposed between the lugs $L_1$,$L_2$ of the end sections, see FIG. 1. Because of the abutting engagement between the second joiner panels 21 and the corners $B_3$,$B_4$ of the end sections 12, the top closure panels 23 cannot move laterally relative to the lugs once they are in interlocking relation with the lugs. Thus, the possibility of the closure panels accidentally assuming an open or unlocked position is avoided.

Besides providing an effective means for locking the closure panels in a closed position, the lugs $L_1$,$L_2$ provide an effective means for stabilizing the container when in a stacked relation with other like containers, as seen in FIG. 9. When stacking the containers, the lugs $L_1$,$L_2$ of the lower container are inserted through the tabbed openings 30 formed in the periphery of the bottom panel 14 of the container disposed immediately above. As the lugs $L_1$,$L_2$ are being inserted through the corresponding openings 30, the tabs 31 formed in the openings will be distorted upwardly thereby preventing any portions of the accommodated produce from being crushed or defaced by the inserted lugs. The recesses $R_1$,$R_2$ formed along the lower edges of the end sections of the upper container, are sized so as to readily accommodate the lugs of the lower container when the containers are arranged in stacked relation.

Because the second joiner panels 21 and top closure panels 23 are not adhesively attached to the end sections, the accommodated produce may be attractively displayed for retail sale without being removed from the container, see FIG. 4. When so displayed, the closure panels 23 are folded outwardly and downwardly and the second joiner panels assume outwardly extending positions, thus providing substantial exposure of the produce both from the side as well as the top.

When the loaded containers are arranged in two or more stacks I,II on a pallet or the like and in a side by side relation, as seen in FIG. 9, the corners of the containers coact to form elongated ventilating passageways P'. The openings 24 formed in joiner panels 15,21 of each container communicate with the passageways P' thereby providing effective ventilation for the produce accommodated in the stacked containers.

Because of the manner in which the blank 33 is folded when setting up the end section 12, the latter is of four ply construction and thus, is possessed of very high strength in resisting both bending and compressive forces. The size and shape of the improved container may vary from that shown and will depend upon the product to be accommodated therein.

The improved container is of simple, lightweight, inexpensive construction and is provided with substantial exposed areas on which attractive graphics or the like may be imprinted. The container may be unfolded so that the accommodated produce may be attractively displayed for retail sale without being removed from the container. The container is provided with suitable means for ventilating the accommodated produce even when the top closure panels are in a fully closed position and a plurality of containers are arranged in stacked relation. The container incorporates novel structural features which prevent relative movement of the top closure panels once they have assumed a closed position thereby enhancing the security of the interlocking relation between the closure panels and the end section lugs.

I claim:

1. A container for produce and the like comprising a central section having a bottom panel, upright side panels arranged in opposed space relation, top closure panels, first joiner panels, each interconnecting a side edge portion of the bottom panel and an adjacent bottom edge portion of a corresponding side panel, and second joiner panes, each foldably connecting an upper edge portion of a side panel to an adjacent side edge portion of a corresponding top closure panel; and a pair of rigid upright end sections disposed in opposed relation and fixedly secured to predetermined portions of said central section, each end section having upwardly protruding means and an adjacent end edge portion of each top closure panel being provided with complemental locking means, the latter coacting to effect locking of the top closure panel in a predetermined folded position relative to said side panels, each second joiner panel being angularly disposed relative to the top closure panel and side panel connected thereto and in abutting engagement with an adjacent corner edge portion of each end section and restraining lateral relative movement of the corresponding top closure panel when the latter is in said predetermined folded positions.

2. The container of claim 1 wherein said top closure panels and second joiner panels have substantially coextensive widths.

3. The container of claim 1 wherein the complemental locking means of each protruding means includes an elongated slot and the complemental locking means of each corresponding top closure panel includes a laterally extending protuberance in substantially coplanar relation with a plane defined by said closure panel for interlockingly engaging the complemental slot when the top closure panel is disposed in said predetermined folded position.

4. The container of claim 3 wherein the complemental slot formed in each protruding means has an open interior side extending substantially the full length of said slot; when each top closure panel is being moved by an externally applied force into said predetermined folded position, at least a portion of each laterally extending protuberance of said closure panel slidably and frictionally engages an interior surface of the protruding means of an adjacent end section until said portion of the laterally extending protuberance is aligned with the open interior side of the corresponding complemental slot whereupon said portion automatically moves into interlocking engagement with the corresponding complemental slot.

5. The container of claim 1 wherein each end section is provided with a recess formed on a lower edge portion thereof, said recess being in substantial vertical alignment with the upwardly protruding means formed on the upper edge portion of said end section, said recess having a configuration whereby a corresponding protruding means of a like second container when stacked therebeneath is adapted to be substantially accommodated therein; the bottom panel of said central section being provided with peripheral openings adjacent said end sections, each opening being in alignment with a recess formed in the lower edge portion of the adjacent end section, each opening being provided with a yieldable tab protruding laterally into the opening from a perimetrical segment of the opening disposed inwardly from the interior surface of the adjacent end section, each yieldable tab being distorted upwardly towards the top closure panels and into the interior of the container for shielding the produce accommodated within the container when the said corresponding protruding means of the like container second extends through the opening upon the second container being stacked therebeneath.

6. The container of claim 1 wherein the upwardly protruding means of each end section includes a pair of laterally spaced protuberances, corresponding protuberances of said end sections coacting to interlock with a top closure panel disposed therebetween when the later is disposed in said predetermined folded position; the bottom panel of the central section being provided with a plurality of peripheral openings adjacent the end sections, each opening being in vertical alignment with a corresponding protuberance of an adjacent end section.

7. The container of claim 1 wherein the central section is formed from a blank of single ply double faced corrugated fiberboard material, and each end section is formed from a second blank of single ply double faced corrugated fibreboard material, each second blank including a plurality of panels folded relative to one another into face to face relation and forming an end section of multi-ply thickness.

* * * * *

UNITED STATES PATENT AND TRADEMARK OFFICE

CERTIFICATE OF CORRECTION

PATENT NO. : 4,645,122

DATED : February 24, 1987

INVENTOR(S) : Terrill L. Nederveld

It is certified that error appears in the above-identified patent and that said Letters Patent is hereby corrected as shown below:

Column 5, line 60, "panes" should be --panels--

Column 6, line 55, "container second" should be --second container--

Signed and Sealed this

Twenty-fifth Day of August, 1987

*Attest:*

DONALD J. QUIGG

*Attesting Officer* *Commissioner of Patents and Trademarks*